United States Patent [19]

Smith

[11] 4,225,977

[45] Oct. 7, 1980

[54] ROLL OF PLASTIC FILM APRONS

[76] Inventor: Buford B. Smith, P.O. Box 3353 109 N. Duncan Rd., Champaign, Ill. 61820

[21] Appl. No.: 59,638

[22] Filed: Jul. 23, 1979

[51] Int. Cl.[2] ..... A41B 13/10

[52] U.S. Cl. ..... 2/48

[58] Field of Search ..... 2/49 R, 49 A, 48, 52; 206/499; 242/55, 53

[56] References Cited

U.S. PATENT DOCUMENTS

| | | | |
|---|---|---|---|
| 2,282,547 | 5/1942 | Spanel | 2/48 |
| 3,496,815 | 2/1970 | Ruhl | 2/48 |
| 3,851,760 | 12/1974 | Smith | 2/49 R |

*Primary Examiner*—Doris L. Troutman
*Attorney, Agent, or Firm*—Neal J. Mosely

[57] ABSTRACT

Disposable plastic film aprons are prepared from plastic film strip material folded longitudinally in indefinite lengths and the folded film strip packaged in roll form and perforated to provide a plurality of readily separable aprons. The plastic film strip has a plurality of perforations extending transversely thereof to separate one apron from the next on said strip and defining a curved bottom to each apron. The strip has perforations defining straps positioned on opposite sides of each apron extending longitudinally thereof to provide tie straps operable to be tied around the neck of the user and also has perforations extending from the longitudinal fold to define a neck opening. The material is cut away in the portion providing the tie straps but the material remains in place at the neck opening and is removed only after severing of the apron from the roll.

3 Claims, 3 Drawing Figures

ROLL OF PLASTIC FILM APRONS

BACKGROUND OF THE INVENTION

1. Field of the Invention

This invention relates to new and useful improvements in disposable plastic film aprons manufactured in strip form, folded longitudinally in indefinite lengths, and perforated to be separated from one another and packaged in rolls.

2. Description of the Prior Art

Disposable bibs or aprons are shown in a variety of prior art references, viz. U.S. Pat. Nos. 2,262,010; 2,424,680; 2,756,430; 2,763,867; 3,001,646; 3,131,399 and 3,221,341. The prior art concerned with disposable bibs and aprons for the most part discloses bibs and aprons of paper which is of inadequate strength for the purpose. Also, the prior art tends to emphasis bib or apron construction which has additional tabs or tie straps or the like secured thereon by sewing or by heat sealing or be adhesive sealing. In the few constructions that are provided with interval tie straps, the straps are usually cut into the material in a form which tears readily in use.

The prior patents of this inventor, B. Bryan Smith U.S. Pat. Nos. 3,735,865 and 3,851,760 disclose rolls of plastic film aprons having constructions somewhat similar to the present invention. This invention is an improvement over this inventor's prior patents, particularly in the design of the tie straps and the arrangement of the perforations for separating one apron from the next and for the removable piece in the neck opening to the aprons.

STATEMENT OF OBJECTS AND FEATURES OF THE INVENTION

It is therefore one object of this invention to provide a new and improved disposable plastic film apron in roll form, folded longitudinally in indefinite lengths, and perforated for separation of individual aprons one from the next.

Another object of this invention is to provide an improved disposable longitudinally folded apron having tie straps formed integrally therewith and packaged in a continuous roll.

A feature of this invention is the provision of a new and improved disposable apron of plastic film stock in strip form of indefinite length, longitudinally folded and perforated for separation one apron from the next and perforated at the longitudinal fold to define a neck opening.

Another feature of this invention is the provision of a new and improved disposable apron of plastic film stock of indefinite length in longitudinally folded strip form, perforated for separation of the aprons into separate units and provided with perforations for separating integral tie strips in the body of the apron and perforations extending from the longitudinal fold to define a neck opening, the arrangement of the perforations being such that the bottom of each apron is curved in shape and the connection from the top of one apron to the bottom of the next has a more extensive perforated portion which reduces the tendency of the aprons to tear apart during manufacture.

Other objects and features of this invention will become apparent from time to time throughout the specification and claims as hereinafter related.

SUMMARY OF THE INVENTION

Disposable plastic film aprons are prepared from plastic film strip material folded longitudinally in indefinite lengths and the folded film strip packaged in roll form and perforated to provide a plurality of readily separable aprons. The plastic film strip has a plurality of perforations extending transversely thereof to separate one apron from the next on said strip and defining a curved bottom to each apron. The strip has perforations defining straps positioned on opposite sides of each apron extending longitudinally thereof to provide tie straps operable to be tied around the neck of the user and also has perforations extending from the longitudinal fold to define a neck opening. The material is cut away in the portion providing the tie straps but the material remains in place at the neck opening and is removed only after severing of the apron from the roll.

DESCRIPTION OF THE PREFERRED EMBODIMENTS

Figure 1:
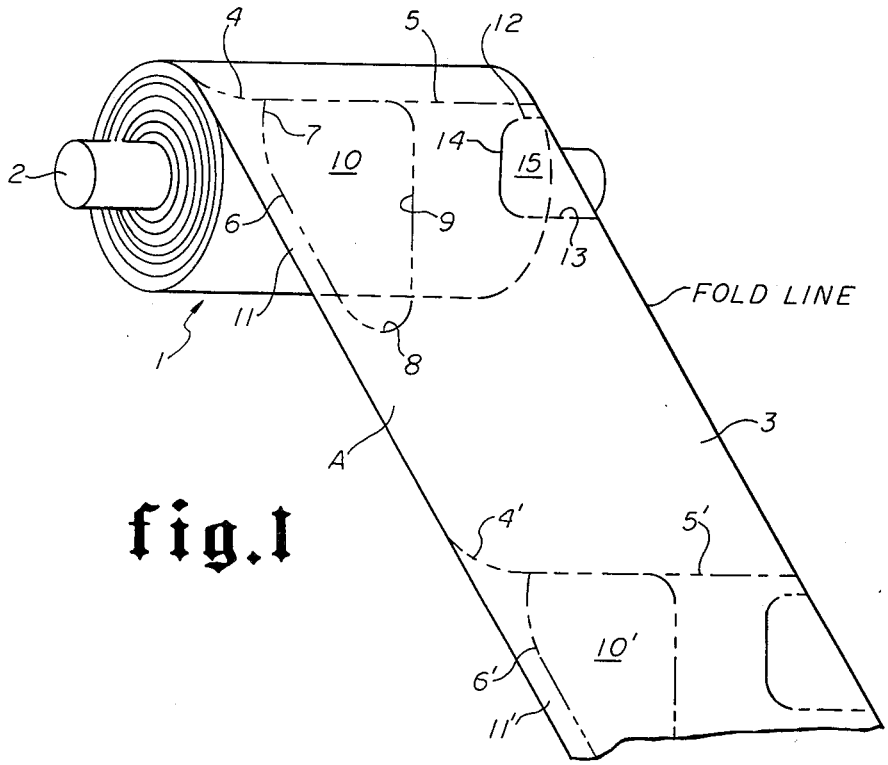
FIG. 1 is an isometric view of a plurality of aprons of plastic strip material folded longitudinally and stored in roll form.

In FIG. 1 of the drawings, there is shown a preferred embodiment of the invention which represents an improvement on the inventor's products disclosed in U.S. Pat. Nos. 3,735,865 and 3,851,760. In this embodiment of the invention, a plurality of disposable aprons are prepared from plastic film material in strip form of indefinite length, e.g. up to many hundreds of feet in length, and stored on a roll.

In FIG. 1, there is shown a roll of aprons 1 which is formed of a strip plastic film material which has been longitudinally folded along the indicated fold line and subsequently perforated and wound in roll form. The fold line of the wound material is indicated at the right side of the isometric view shown in FIG. 1 of the drawing. The roll 1 is provided with a supporting rod or roller 2 on which the longitudinally folded plastic film material 3 is wound.

The longitudinally folded plastic film 3 is perforated along longitudinally extending tear lines 5 and 5'. The tear lines 5 and 5' are transversely extending perforations which started from the fold line and extend straight across the material curving upward along a perforated curved line 4 and 4'. At the upper end of each apron, adjacent to the line of perforations 4 and 5, there are provided a plurality of perforations 6 which have a curved upper portion 7, curved along a base portion 8 and extend back along a line 9 to the tear line 5. The perforations 7, 8 and 9 define a portion 10 which is cut out from the material in processing. The removal of the cut out portion 10 during processing leaves the individual apron connected through a tie strap 11 which extends to and connects to the next succeeding apron along a curved perforated line 4. This curved perforated line 4 provides for a stronger connection of one apron to the next which is less likely to tear apart during processing and also produces a curved bottom to the apron when it is separated from the roll.

Figure 3:
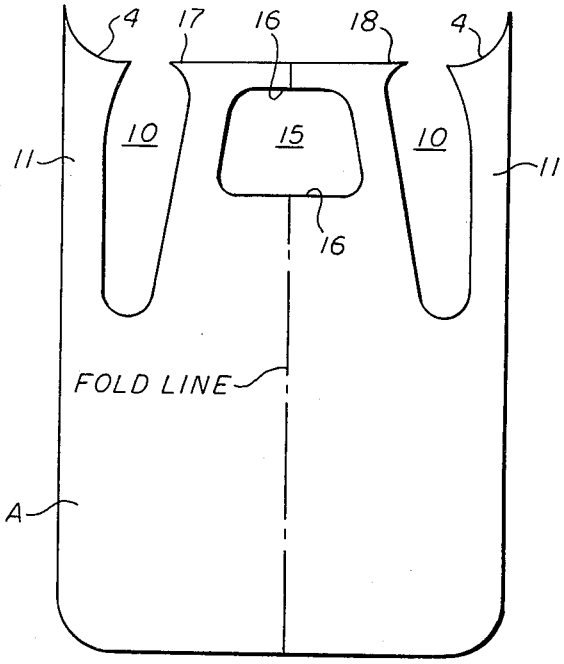
FIG. 3 is a plan view showing one of the plastic film aprons removed from the roll and folded.

At the upper part of the apron, adjacent to the tear line of perforations 5, there is provided a plurality of perforations 12 at the upper side adjacent to the fold line and a plurality of perforations 13 which are connected by a curved line 14 which is cut completely through the material. The tear lines 12 and 13 and cut line 14 define a removable piece 15 which is an arcuate cut out, removable from the apron in use. The arcuate cut out 15 must be left in place during processing of the apron and must be left in place while the aprons are wound on the roll 1. When the aprons are removed from the roll 1 and torn apart the cut out 15 is torn out by the user to provide a neck opening 16 as is shown in FIG. 3. The cut out portion 15 must not be removed during manufacture since it is required to permit the aprons to be processed and rolled and to be pulled from a finished roll without distortion.

Figure 2:
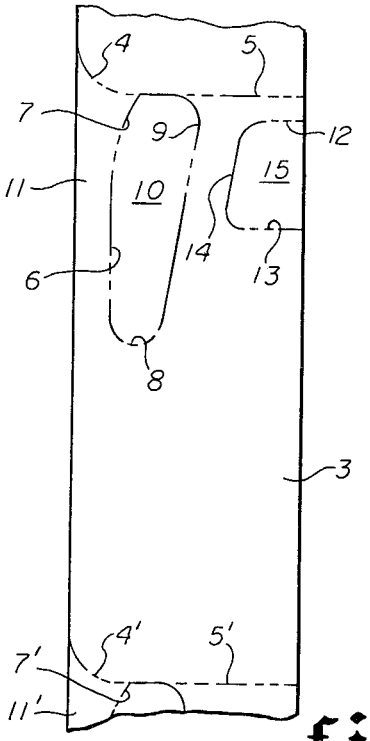
FIG. 2 is a plan view of one of the folded aprons removed from the roll shown in FIG. 1.

Each successive apron on the roll is provided with the same arrangement of perforations and tear lines for removal of one apron from the next and for removal of the cut out portion 15 which provides a neck opening in the apron. In FIGS. 1 and 2 the arrangement of perforations for succeeding aprons is numbered the same as the first apron with the addition of a prime to each of the reference numerals.

In FIG. 3, one of the aprons is shown removed from the roll 1 and opened along the fold line. The cut out portions 10 and 15 are in the same relation as shown in FIG. 1. The cut out portions 10 were, of course, removed during manufacture. Cut out portions 15 is removed by the user and defines a neck opening 16. Neck opening 16 is designed to be placed over the head of the user and tie straps 11 are used to tie the apron in place. Tie straps 11 have curved upper edges 4 which correspond to the perforations along which the tie straps were torn. The upper edge of the apron adjacent to neck opening 16 is curved outward as indicated at 17 and 18. This design of tear lines provides for a more extended connection of one apron to the next and prevents the aprons from being pulled apart during processing. Also, this arrangement of tear lines provides for the curved bottom shape to the apron as seen in FIG. 3, wherein the bottom of the apron has a curvature corresponding to perforations or tear lines 4 at the upper end of the tie straps 11.

The plastic film used in the manufacture of these aprons may be of any suitable type and is selected largely for economic reasons. Generally, polyethylene film is the most economical and the most suitable for the purpose. However, other suitable plastic films, such as polyvinyl chloride, vinylidene chloride polymers, rubber hydrochloride, polyesters, cellulose esters, etc., may be used. The thickness of the film used in the manufacturing the aprons is dependent strictly upon the toughness of the film and the type of wear or use to which the apron may be put. The films used in the manufacture of the aprons therefore may vary from a fraction of a mil in thickness up to several mils, perhaps as heavy as 5 or 10 mils in thickness. Usually a film of 1 to 2 mils of thickness is adequate for the product.

The aprons shown may be manufactured in continuous lengths and stored on rolls as illustrated in FIG. 1. The rolls may be placed in dispensing cartons of any suitable design (not shown). A preferred arrangement is to provide rolls having 50 or 100 aprons or more. It will be obvious, of course, to those skilled in the art that smaller or larger rolls and smaller or larger storage or dispensing cartons can be used.

This invention represents an improvements over the inventor's prior patented products mainly in the arrangement of perforations and the arrangement for retaining the cut out for the neck opening in place. The arrangement of perforations provides a more extensive tear line at the point of connection of one apron to the next and thus avoids problems encountered during the manufacturing operation when the folded plastic material is perforated, part of the material cut out and removed, and the resulting product wound on a roll. In the prior product, there were occasional problems with the aprons tearing apart or separating during processing or during winding on a roll. This tendency was not great but was enough to create occasional manufacturing difficulties. The redesign of the perforations provides for a more extensive perforated connection of one apron to the next which reduces the tendency of the aprons to come apart during processing.

While this invention has been described fully and completely, as required by the Patent Statutes, with reference to a single preferred embodiment, it should be understood that within the scope of the appended claims the invention may be practiced otherwise than as specifically described and shown herein.

I claim:

1. A roll of plastic film aprons comprising an elongated strip of plastic film folded in half longitudinally in substantially extended lengths and wound in said longitudinally folded form as a roll on a core or roller, said longitudinally folded film having a plurality of perforations and cut lines defining a plurality of longitudinally folded aprons connected end to end in said roll, a first set of said perforations and cut lines being spaced longitudinally along said strip at predetermined equally spaced intervals and extending transversely to said strip from the fold line thereof and terminating in a curved end portion at the edges of said strip, a second set of cut lines defining an extended, arcuate cut out portion beginning at said curved end portion of said first perforations or cut lines, extending longitudinally along a line inclined toward the center, curving transversely, and then extending back to said transversely extending perforations or cut lines and terminating in an end portion curved toward the edge of said strip, to define tie straps on each side of said aprons, a third set of perforations and cut lines adjacent to and spaced from said first perforations, extending along an arcuate line from and returning to the fold line of said strip, and defining a subsequently removable portion for producing a neck opening in said apron, and said aprons being severable one by one from said roll along said first set of perforations and cut lines and having tie straps extending upward from a base portion and having a central neck opening when unfolded.

2. A roll of plastic film aprons according to claim 1 in which said first set of perforations and cut lines define a connection of sufficient strength to prevent severing during manufacture but easily separable in use.

3. A roll of plastic film aprons according to claim 2 in which said third set of perforations and cut lines includes a continuous cut line extending longitudinally and arcuately at each end and transverse perforations for removal of said neck opening portion.

* * * * *